US012258673B2

(12) United States Patent
Tomita

(10) Patent No.: US 12,258,673 B2
(45) Date of Patent: Mar. 25, 2025

(54) PLATING APPARATUS

(71) Applicant: EBARA CORPORATION, Tokyo (JP)

(72) Inventor: Masaki Tomita, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/781,365

(22) PCT Filed: Nov. 9, 2021

(86) PCT No.: PCT/JP2021/041137
§ 371 (c)(1),
(2) Date: May 31, 2022

(87) PCT Pub. No.: WO2023/084584
PCT Pub. Date: May 19, 2023

(65) Prior Publication Data

US 2024/0183056 A1 Jun. 6, 2024

(51) Int. Cl.
*C25D 17/06* (2006.01)
*C25D 21/10* (2006.01)

(52) U.S. Cl.
CPC ..... *C25D 17/06* (2013.01); *C25D 21/10* (2013.01)

(58) Field of Classification Search
None
See application file for complete search history.

(56) References Cited

U.S. PATENT DOCUMENTS

2005/0072358 A1* 4/2005 Katsuoka ..... C25D 17/001 118/719
2018/0182659 A1 6/2018 Yokoyama et al.

FOREIGN PATENT DOCUMENTS

| | | | |
|---|---|---|---|
| JP | 2004-076022 | A | 3/2004 |
| JP | 2008-190043 | A | 8/2008 |
| JP | 2018-009215 | A | 1/2018 |
| JP | 6899040 | B1 | 7/2021 |
| KR | 2017-0068974 | A | 6/2017 |
| KR | 2018-0073438 | A | 7/2018 |

* cited by examiner

*Primary Examiner* — Louis J Rufo
(74) *Attorney, Agent, or Firm* — BakerHostetler

(57) ABSTRACT

Provided is a plating apparatus that allows suppressing a substrate sticking to a back plate assembly.
A plating apparatus includes a plating tank configured to house a plating solution, a substrate holder configured to hold a substrate Wf with a surface to be plated Wf-a facing downward, and an elevating mechanism configured to move up and down the substrate holder. The substrate holder includes a supporting mechanism 460 configured to support an outer peripheral portion of the surface to be plated Wf-a of the substrate Wf, a back plate assembly 470 arranged on a back surface side of the surface to be plated Wf-a of the substrate Wf and configured to sandwich the substrate Wf with the supporting mechanism 460, and a removing mechanism 471 configured to provide a force that removes the substrate Wf from the back plate assembly 470 to a back surface of the surface to be plated Wf-a of the substrate Wf.

7 Claims, 9 Drawing Sheets

1000

PLATING APPARATUS

TECHNICAL FIELD

This application relates to a plating apparatus.

BACKGROUND ART

There has been known a cup type electroplating apparatus as an example of a plating apparatus. The cup type electroplating apparatus immerses a substrate (such as a semiconductor wafer) held by a substrate holder in a plating solution with a surface to be plated facing downward, and causes a conductive film to deposit on a surface of the substrate by applying voltage between the substrate and an anode.

For example, PTL 1 discloses a substrate holder including a ring-shaped supporting member that supports an outer peripheral portion of a surface to be plated of a substrate and a back plate assembly arranged on a back surface side of the surface to be plated of the substrate. The substrate holder is configured to sandwich the substrate between the supporting member and the back plate assembly by pressing the back plate assembly against a back surface of the surface to be plated of the substrate supported by the supporting member.

CITATION LIST

Patent Literature

PTL 1: Japanese Patent No. 6899040

SUMMARY OF INVENTION

Technical Problem

A substrate holder according to the prior art has room for improvement in suppressing a substrate sticking to a back plate assembly.

That is, in the prior art, when the substrate is installed to the substrate holder while front and back sides of the substrate are in a wet state due to a plating preprocess or the like, sticking (attaching) caused by a surface tension between the substrate and the back plate assembly occurs in some cases. In this case, when the back plate assembly is raised after a plating process is completed, the substrate may be raised together being stuck to the back plate assembly, which may possibly result in a transfer failure of the substrate.

Therefore, one object of this application is to suppress the substrate sticking to the back plate assembly.

Solution to Problem

One embodiment discloses a plating apparatus that includes a plating tank, a substrate holder, and an elevating mechanism. The plating tank is configured to house a plating solution. The substrate holder is configured to hold a substrate with a surface to be plated facing downward. The elevating mechanism is configured to move up and down the substrate holder. The substrate holder includes a supporting mechanism, a back plate assembly, and a removing mechanism. The supporting mechanism is configured to support an outer peripheral portion of the surface to be plated of the substrate. The back plate assembly is arranged on a back surface side of the surface to be plated of the substrate. The back plate assembly is configured to sandwich the substrate with the supporting mechanism. The removing mechanism is configured to provide a force that removes the substrate from the back plate assembly to a back surface of the surface to be plated of the substrate.

DESCRIPTION OF EMBODIMENTS

Figure 1:
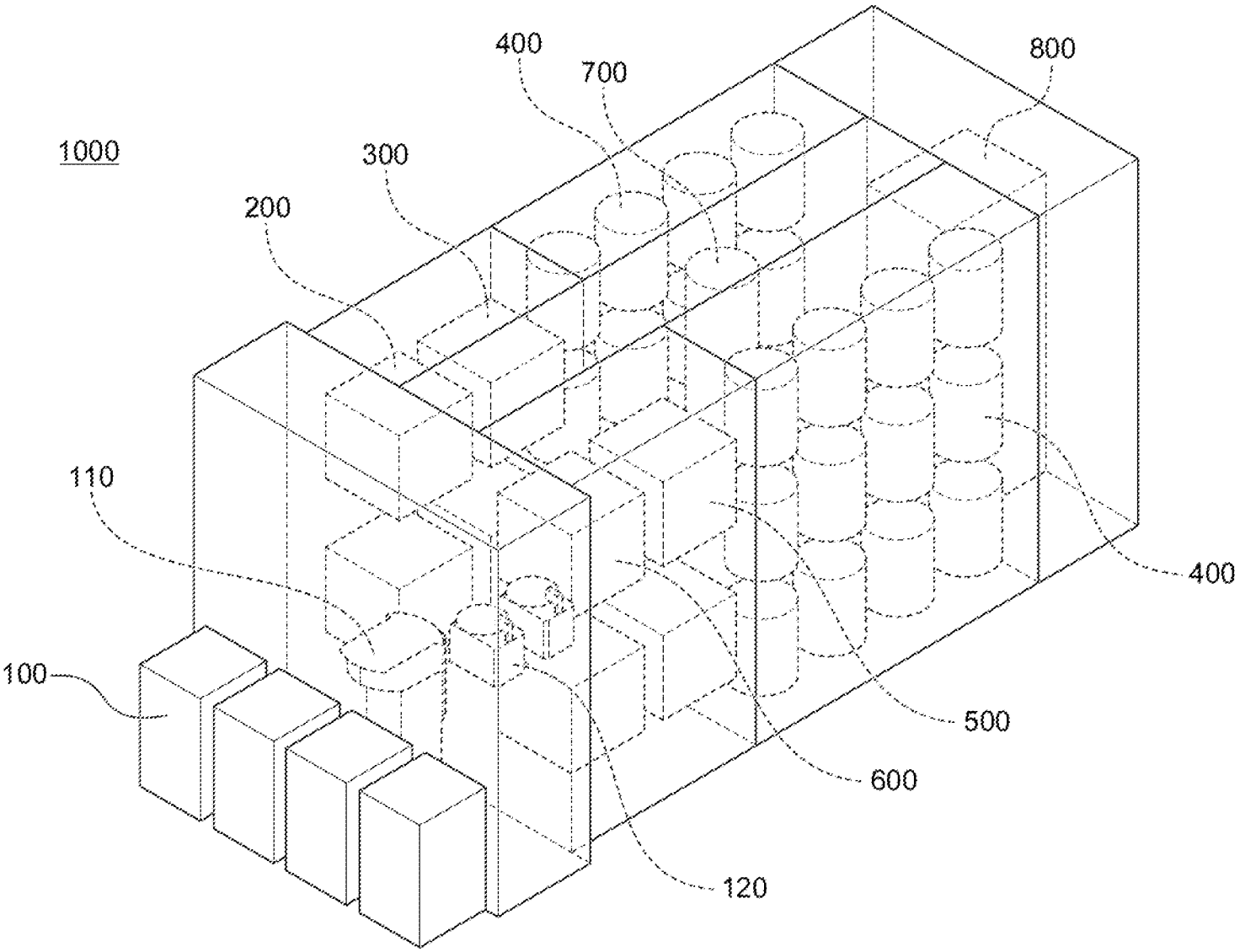
FIG. 1 is a perspective view illustrating an overall configuration of a plating apparatus of this embodiment.

The following will describe embodiments of the present invention with reference to the drawings. In the following described drawings, an identical reference numeral is attached to an identical or corresponding component and an overlapping description will be omitted.

<Overall Configuration of Plating Apparatus>

Figure 2:
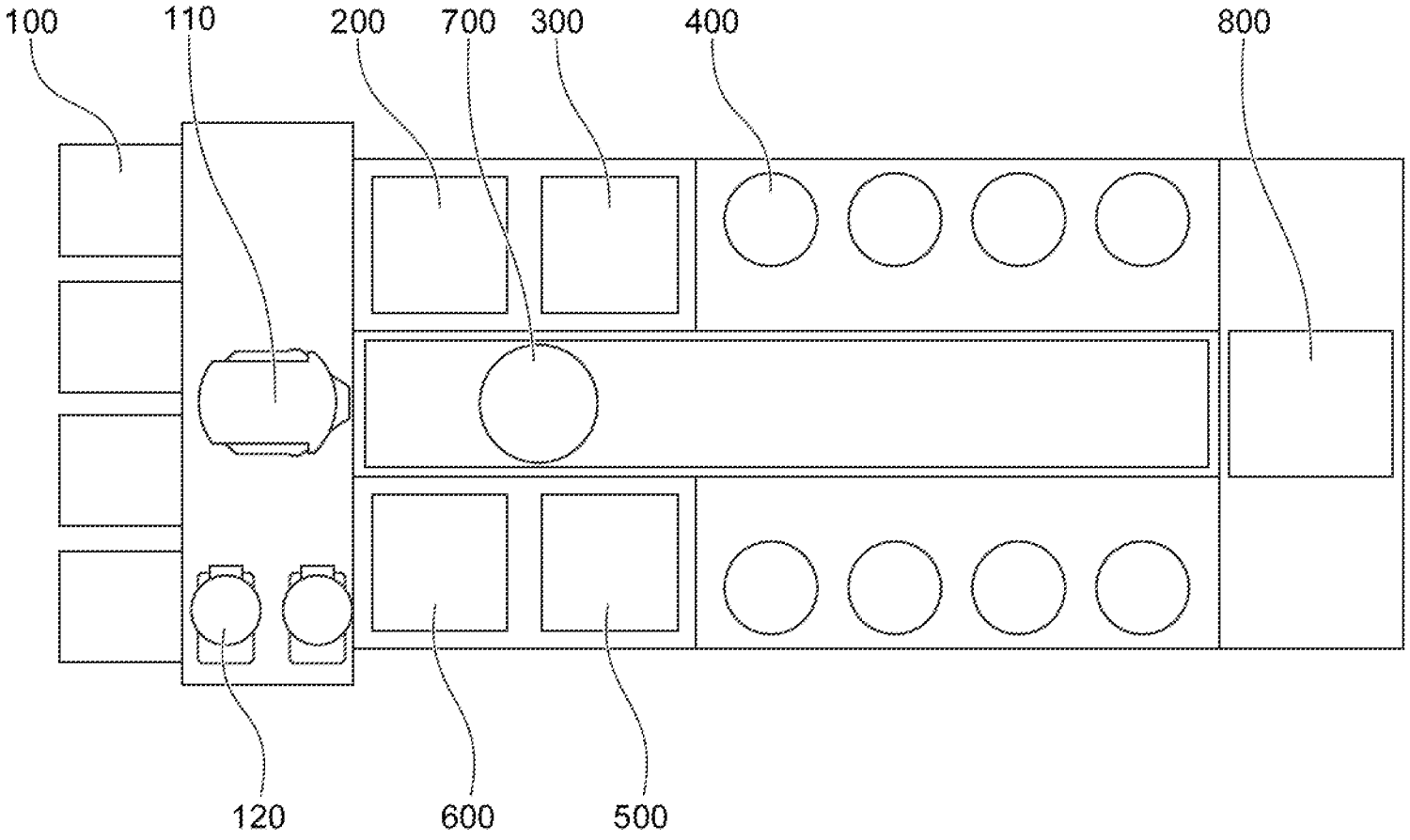
FIG. 2 is a plan view illustrating the overall configuration of the plating apparatus of this embodiment.

FIG. 1 is a perspective view illustrating the overall configuration of the plating apparatus of this embodiment. FIG. 2 is a plan view illustrating the overall configuration of the plating apparatus of this embodiment. As illustrated in FIGS. 1 and 2, a plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, the pre-wet module 200, and the spin rinse dryers 600. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers are disposed to be arranged in the vertical direction in this embodiment, the number of spin rinse dryers and arrangement of the spin rinse dryers are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the pre-wet module 200.

The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer robot 110 receives the substrate from the spin rinse dryer 600 and transfers the substrate, on which the drying process is performed, to the cassette at the load port 100. Finally, the cassette housing the substrate is unloaded from the load port 100.

<Configuration of Plating Module>

Figure 3:
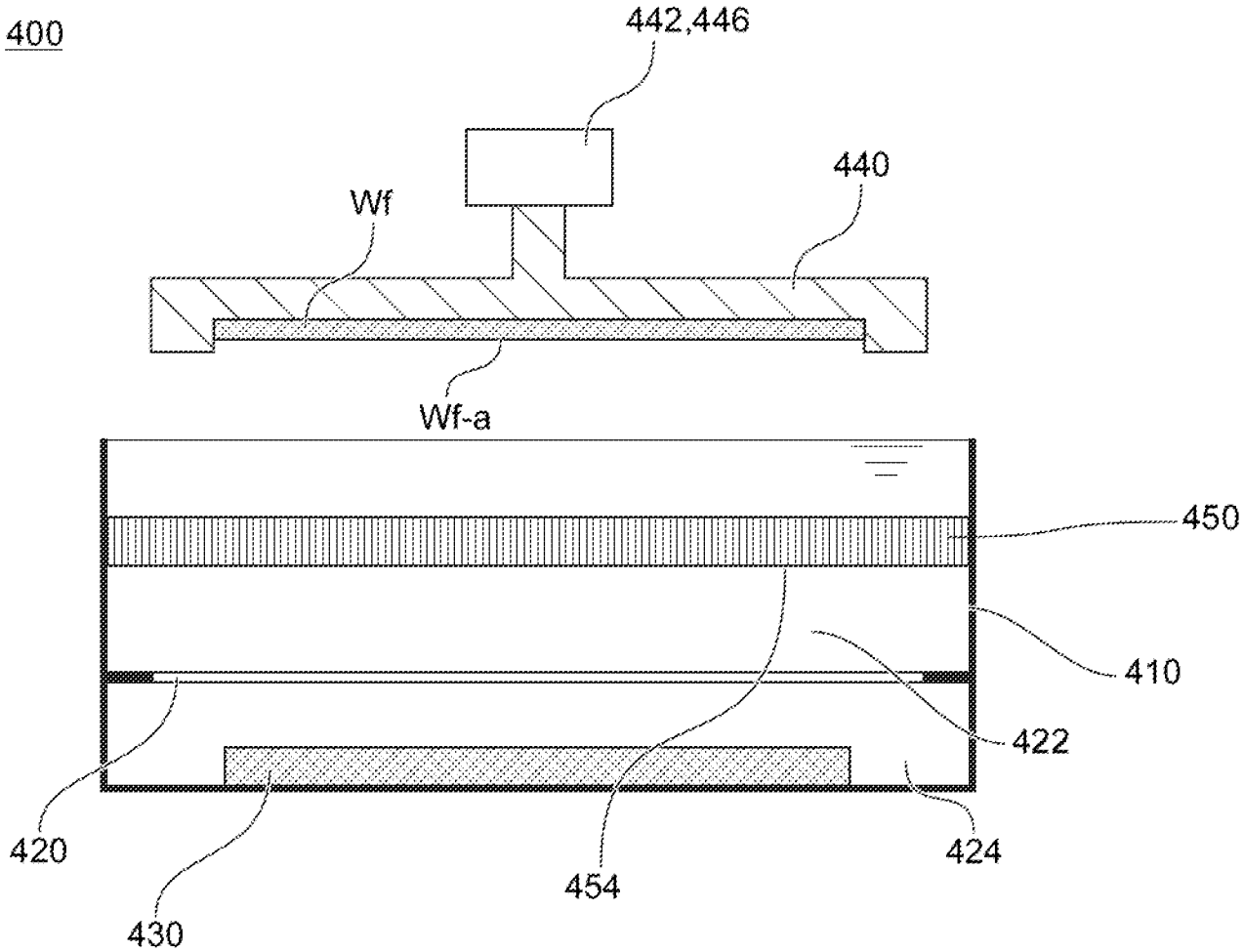
FIG. 3 is a vertical cross-sectional view schematically illustrating a configuration of a plating module of this embodiment.

Next, a configuration of the plating modules 400 will be described. Since the 24 plating modules 400 according to this embodiment have the identical configuration, only one plating module 400 will be described. FIG. 3 is a vertical cross-sectional view schematically illustrating the configuration of the plating module 400 of a first embodiment. As illustrated in FIG. 3, the plating module 400 includes a plating tank 410 for housing a plating solution. The plating module 400 includes a membrane 420 that separates an inside of the plating tank 410 in the vertical direction. The inside of the plating tank 410 is divided into a cathode region 422 and an anode region 424 by the membrane 420. The cathode region 422 and the anode region 424 are each filled with the plating solution. An anode 430 is disposed on a bottom surface of the plating tank 410 in the anode region 424. An ionically resistive element 450 opposed to the membrane 420 is arranged in the cathode region 422. The ionically resistive element 450 is a member for uniformizing the plating process on a surface to be plated Wf-a of a substrate Wf and configured by a plate-shaped member where many holes are formed.

Further, the plating module 400 includes a substrate holder 440 for holding the substrate Wf with the surface to be plated Wf-a facing downward. The substrate holder 440 includes a power feeding contact point (not illustrated) for feeding power from a power source to the substrate Wf. The plating module 400 includes an elevating mechanism 442 for moving up and down the substrate holder 440. The elevating mechanism 442 can be achieved by a known mechanism, such as a motor. The plating module 400 is configured to perform the plating process on the surface to be plated Wf-a of the substrate Wf by immersing the substrate Wf in the plating solution in the cathode region 422 using the elevating mechanism 442 and applying voltage between the anode 430 and the substrate Wf.

Further, the plating module 400 includes a rotation mechanism 446 for rotating the substrate holder 440 such that the substrate Wf rotates about a virtual rotation axis extending perpendicularly in a center of the surface to be plated Wf-a. The rotation mechanism 446 can be achieved by a known mechanism, such as a motor.

<Configuration of Substrate Holder>

Figure 4:
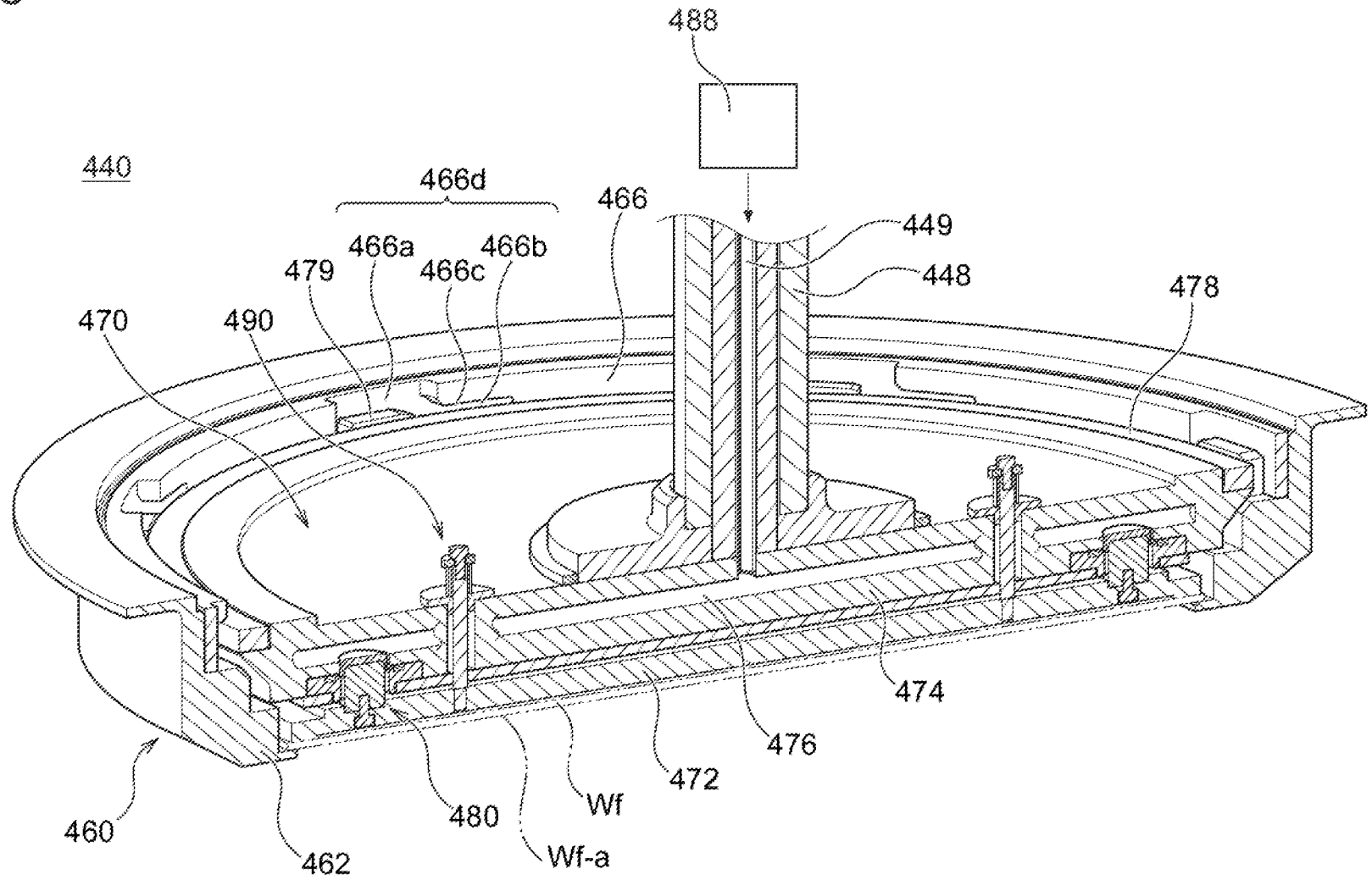
FIG. 4 is a perspective view schematically illustrating a configuration of a substrate holder of this embodiment.
Figure 5:
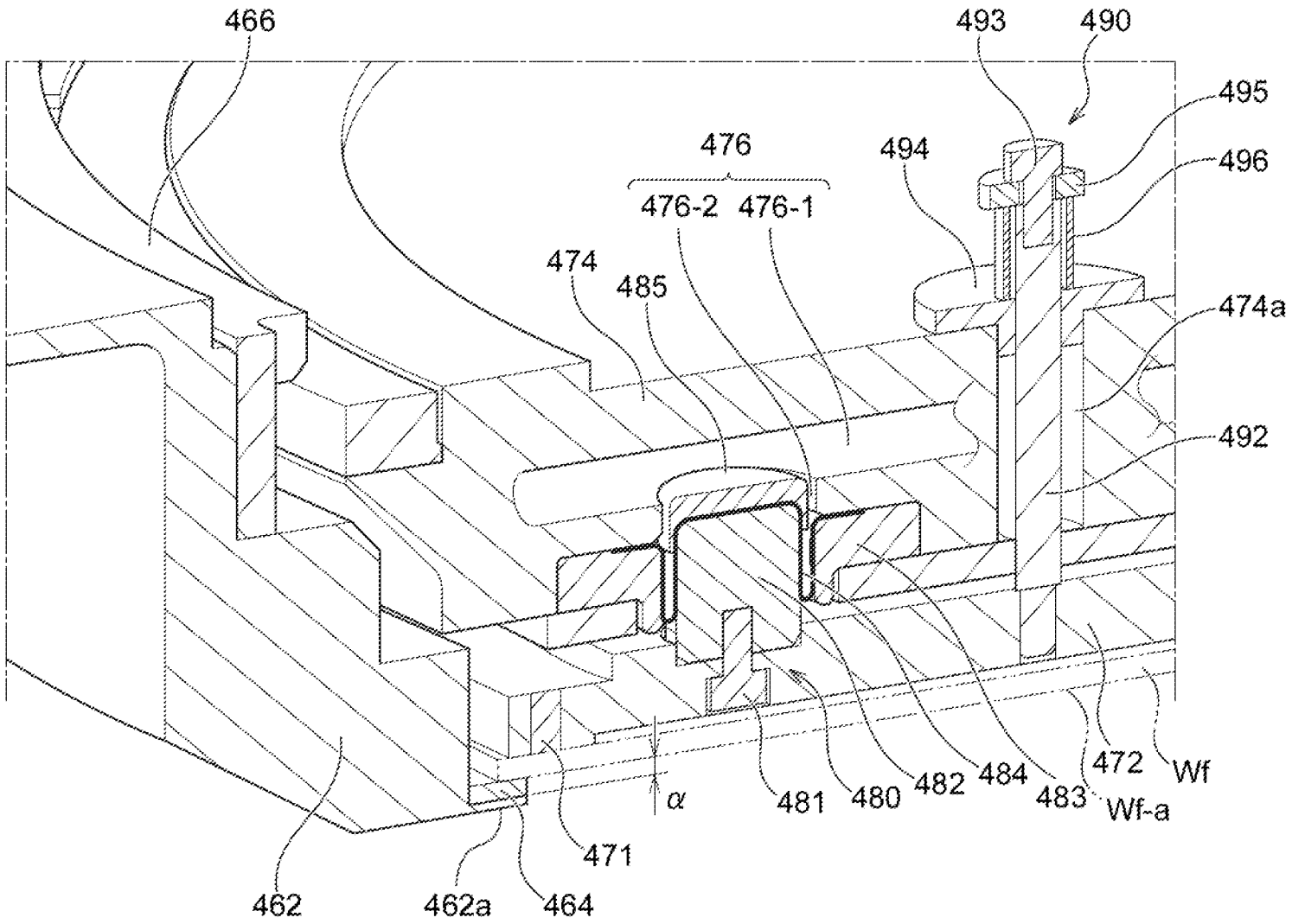
FIG. 5 is an enlarged perspective view schematically illustrating a part of the substrate holder of this embodiment.

Next, the detail of the substrate holder 440 of this embodiment will be described. FIG. 4 is a perspective view schematically illustrating a configuration of the substrate holder of this embodiment. FIG. 5 is an enlarged perspective view schematically illustrating a part of the substrate holder of this embodiment.

As illustrated in FIGS. 4 and 5, the substrate holder 440 includes a supporting mechanism 460 for supporting an outer peripheral portion of the surface to be plated Wf-a of the substrate Wf, a back plate assembly 470 for holding the substrate Wf, and a rotation shaft 448 extending vertically upward from the back plate assembly 470.

The back plate assembly 470 includes a circular plate-shaped floating plate 472 for sandwiching the substrate Wf with the supporting mechanism 460. The floating plate 472 is arranged on a back surface side of the surface to be plated Wf-a of the substrate Wf. Further, the back plate assembly 470 includes floating mechanisms 490 and a pushing mechanism 480. The floating mechanisms 490 are for biasing the floating plate 472 to a direction away from a back surface of the substrate Wf. The pushing mechanism 480 is for pressing the floating plate 472 to the back surface of the substrate Wf against a biasing force by the floating mechanisms 490.

The pushing mechanism 480 includes a circular plate-shaped back plate 474 arranged on an upper side of the floating plate 472 and a flow passage 476 formed inside the back plate 474. The flow passage 476 includes a first flow passage 476-1 and second flow passages 476-2. The first flow passage 476-1 extends radially from a center portion of the back plate 474 toward an outer peripheral portion. The second flow passages 476-2 extend in the vertical direction so as to open from the first flow passage 476-1 to a lower surface of the back plate 474. The pushing mechanism 480 includes diaphragms 484 arranged in the second flow passages 476-2. The diaphragm 484 is a thin film-shaped member. The diaphragm 484 has an outer peripheral portion secured to the lower surface of the back plate 474 by a securing member 483. The pushing mechanism 480 includes rods 482, as an aspect of pressing members, arranged between the diaphragms 484 and the floating plate 472. The rod 482 has a lower surface secured to the floating plate 472 by a bolt 481, and the rod 482 has an upper surface in contact with a lower surface of the diaphragm 484. The rod 482 has an upper portion covered with a cap 485 sandwiching the diaphragm 484. The diaphragm 484 has a center portion sandwiched by the cap 485 and the rod 482. A plurality of the diaphragms 484, the rods 482, and the caps 485 are disposed along the circumferential direction of the back plate assembly 470. Note that while this embodiment has shown the example in which the rods 482 as different members from the floating plate 472 are secured to an upper surface of the floating plate 472, it is not limited thereto. For example, projections may be formed on the upper surface of the floating plate 472 along the circumferential direction. In this case, the projections have a function as the pressing member similar to the rod 482.

The pushing mechanism 480 includes a fluid source 488 for supplying a fluid to the diaphragms 484. The fluid may be a gas, such as air, or may be a liquid, such as water. In the rotation shaft 448, a flow passage 449 extending along the gravity direction is formed, and the fluid source 488 is connected to an upper end of the flow passage 449. The flow passage 449 has a lower end connected to the first flow passage 476-1 formed in the back plate 474. The first flow passage 476-1 extends radially from a center of the back plate 474 and communicates with upper surfaces of the caps 485 via the second flow passages 476-2. The fluid source 488 supplies the fluid to the diaphragms 484 via the flow passage 449 and the flow passage 476. Then, the caps 485 and the rods 482 are pressed downward, whereby the floating plate 472 is pressed downward.

The supporting mechanism 460 includes a circular supporting member 462 for supporting the outer peripheral portion of the surface to be plated Wf-a of the substrate Wf. The supporting member 462 has a flange 462*a* protruding to an outer peripheral portion of a lower surface of the back plate assembly 470. A circular sealing member 464 is arranged on the flange 462*a*. The sealing member 464 is a member having elasticity. The supporting member 462 supports the outer peripheral portion of the surface to be plated Wf-a of the substrate Wf via the sealing member 464. Sandwiching the substrate Wf between the sealing member 464 and the floating plate 472 seals between the supporting member 462 and the substrate Wf. Since the sealing member 464 has elasticity, the sealing member 464 is crushed in accordance with a pressing force of the substrate Wf by the pushing mechanism 480 to vary a thickness $\alpha$.

The supporting mechanism 460 includes a circular clamper 466 held by the supporting member 462. The clamper 466 can move up and down the back plate assembly 470 with respect to the supporting mechanism 460 when the substrate Wf is installed to/extracted from the substrate holder 440. Further, the clamper 466 can restrict the back plate 474 from moving to an upward direction (the direction away from the back surface of the substrate Wf) when the fluid is supplied from the fluid source 488 to the diaphragms 484. This point will be described below.

The back plate assembly 470 includes a slide ring 478 circularly disposed on the outer peripheral portion of an upper surface of the back plate 474. The slide ring 478 is movable in the circumferential direction independently of the back plate 474. The back plate assembly 470 includes slide plates 479 projecting from the slide ring 478 toward the clamper 466.

On the other hand, hook-like cutouts 466*d* are formed on a surface opposed to the slide ring 478 in the clamper 466. The hook-like cutout 466*d* has a first groove 466*a* and a second groove 466*b*. The first groove 466*a* extends in the vertical direction such that the slide plate 479 can be moved up and down. The second groove 466*b* communicates with the first groove 466*a* and extends along the circumferential direction of the clamper 466. The second groove 466*b* has an upper surface on which an abutting surface 466*c* is formed. The abutting surface 466*c* abuts on an upper surface of the slide plate 479 moving in accordance with a movement in the upward direction of the back plate 474 when the fluid is supplied from the fluid source 488 to the diaphragms 484. A plurality of the slide plates 479 and the cutouts 466*d* are disposed along the circumferential direction of the substrate holder 440.

When the substrate Wf is installed with respect to the substrate holder 440, the back plate assembly 470 is positioned on an upper side with respect to the supporting mechanism 460. When the substrate Wf is placed with respect to the supporting mechanism 460 in this state, the back plate assembly 470 can be moved down with respect to the supporting mechanism 460 by adjusting positions in the circumferential direction of the slide plates 479 to the first grooves 466*a*. After the back plate assembly 470 is moved down, the slide plates 479 are fit in the second grooves 466*b* by rotating the slide ring 478 in the circumferential direction. Since this causes the slide plates 479 to be opposed to the abutting surfaces 466*c*, a movement in the upward direction of the back plate assembly 470 is restricted.

The floating mechanism 490 includes a shaft 492 extending from the floating plate 472 to the upper side via a through-hole 474*a* of the back plate 474. The shaft 492 has a lower end secured to the floating plate 472. The floating mechanism 490 includes a flange 495 mounted on an upper portion of the shaft 492 with respect to the back plate 474. The flange 495 is mounted on an upper end of the shaft 492 by a bolt 493. The floating mechanism 490 includes a guide 494 disposed in the through-hole 474*a*. The guide 494 has a hole slightly larger than an outer diameter of the shaft 492 and is mounted on an upper end of the through-hole 474*a*. The guide 494 is configured to guide a movement in an elevating direction of the shaft 492. By providing the guide 494, generation of misalignment in a radial direction of the floating plate 472 and the back plate 474 can be suppressed.

The floating mechanism 490 includes a compression spring 496 mounted on an upper surface of the guide 494 and a lower surface of the flange 495. The compression spring 496 may be disposed between the upper surface of the back plate 474 and the lower surface of the flange 495. Since the compression spring 496 has a biasing force that lifts the flange 495 upward, the floating plate 472 is biased to the direction away from the back surface of the substrate Wf via the shaft 492.

When the fluid is supplied from the fluid source 488, the pushing mechanism 480 presses the substrate Wf to the sealing member 464 with a force stronger than the biasing force by the floating mechanisms 490. The pushing mechanism 480 can vary a holding position of the substrate Wf depending on a pressure of the fluid supplied from the fluid source 488.

Since a crushing amount of the sealing member 464 increases as the pressure of the fluid supplied from the fluid source 488 increases, the thickness of the sealing member 464 becomes thinner in proportion to the increase of the pressure of the fluid supplied from the fluid source 488. The thickness of the sealing member 464 becoming thinner means that the holding position of the substrate Wf is moved downward, resulting in a distance between the anode 430 and the substrate Wf becoming shorter. That is, by adjusting a flow rate of the fluid supplied from the fluid source 488, the distance between the anode 430 and the substrate Wf can be adjusted. Therefore, with this embodiment, by adjusting the distance between the anode 430 and the substrate Wf according to a type of the substrate Wf, uniformity of a plating film thickness of the surface to be plated Wf-a can be improved. Further, as illustrated in FIG. 5, the substrate holder 440 includes a removing mechanism 471 configured to provide a force to remove the substrate Wf from the back plate assembly 470 to the back surface of the surface to be plated Wf-a of the substrate Wf. The following will describe the removing mechanism 471 in detail.

<Configuration of Removing Mechanism>

Figure 6:
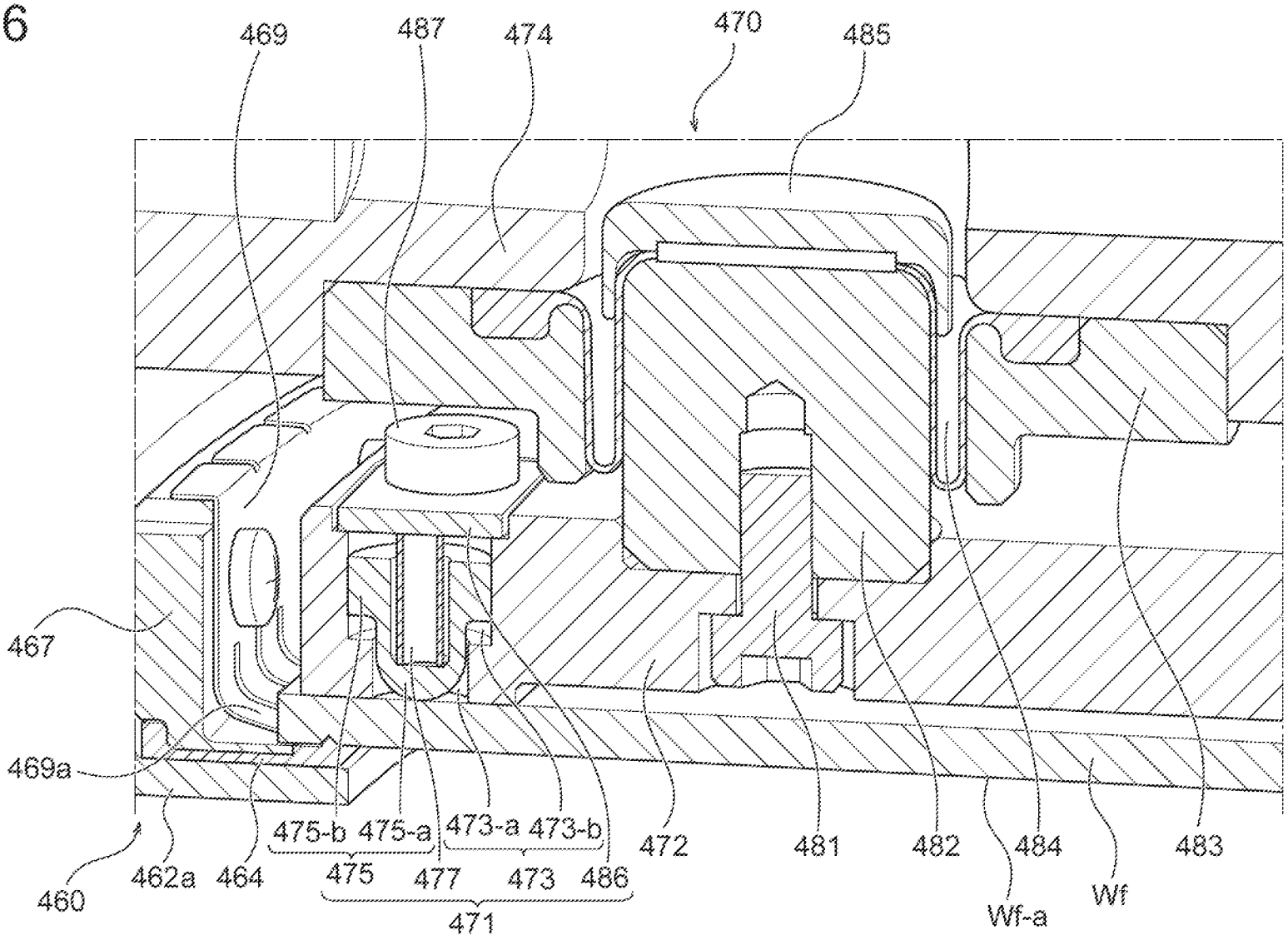
FIG. 6 is an enlarged perspective view schematically illustrating a part of the substrate holder of this embodiment.

FIG. 6 is an enlarged perspective view schematically illustrating a part of the substrate holder of this embodiment. As illustrated in FIG. 6, the substrate holder 440 includes a pedestal 467 supported by the supporting mechanism 460, and a contact 469 mounted on the pedestal 467. The pedestal 467 is, for example, a circular member having a conductive property, such as stainless steel. The contact 469 is a member mounted on an inner peripheral surface of the pedestal 467 by a screw or the like and having a conductive property, and is electrically connected to a power source (not illustrated). Although not illustrated in FIG. 6, a plurality of the contacts 469 are arranged along the inner peripheral surface of the pedestal 467. A plurality of power feeding contact points 469-*a* are formed in the contact 469. The plurality of power feeding contact points 469-*a* are brought into contact with the outer peripheral portion of the surface to be plated Wf-a of the substrate Wf and enables feeding power to the substrate Wf.

As illustrated in FIG. 6, the removing mechanism 471 includes a removing member 475 arranged in a hole 473 opening to a surface (specifically a lower surface of the floating plate 472) in contact with the back surface of the surface to be plated Wf-a of the substrate Wf of the back plate assembly 470. Specifically, in this embodiment, the hole 473 is a through-hole penetrating the lower surface and the upper surface of the floating plate 472. An opening in an upper side of the hole 473 is covered by a plate-shaped pedestal 486. The pedestal 486 is secured to the floating plate 472 by a bolt 487.

The hole 473 is formed including a first hole 473-*a* opening in the lower surface of the floating plate 472 and having a first diameter, and a second hole 473-*b* having a second diameter that is larger than the first diameter and communicating with the first hole 473-*a*. The removing member 475 includes a removing pin 475-*a* having a size corresponding to the first diameter, and a flange portion 475-*b* having a size corresponding to the second diameter is formed in the removing pin 475-*a*. A distal end portion of the removing pin 475-*a* in contact with the substrate Wf is formed in a hemispherical shape. The removing member 475 can be constituted of, for example, a resin, such as PVC, PP, PPS, PEEK, or PTFE, or an antistatic grade resin.

The removing mechanism 471 includes an elastic member 477 that provides a force that causes the removing member 475 to project from the lower surface of the floating plate 472. The elastic member 477 can be constituted of, for example, a compression spring. The elastic member 477 is inserted in a hole formed in a central portion of a base end of the removing pin 475-*a*, and is mounted on a bottom surface of the hole and the pedestal 486.

This embodiment allows suppressing the substrate Wf sticking to the back plate assembly 470 (the floating plate 472). That is, when the substrate is installed to the substrate holder 440 while front and back surfaces of the substrate Wf are in a wet state due to a plating preprocess or the like, sticking (attaching) caused by a surface tension between the substrate Wf and the back plate assembly 470 occurs in some cases. In this case, when the back plate assembly 470 is raised after the plating process is completed, the substrate Wf may be raised together being stuck to the back plate assembly 470, which may possibly result in a transfer failure of the substrate.

In contrast to this, with this embodiment, as illustrated in FIG. 6, in a state where the back plate assembly 470 (the floating plate 472) is pressing the substrate Wf, the elastic member 477 shrinks and the removing member 475 is pulled into the hole 473. When the back plate assembly 470 is raised after the plating process is completed in this state, the elastic member 477 extends and presses the removing member 475. In response, the removing member 475 moves downward until the flange portion 475-*b* of the removing pin 475-*a* is brought into contact with a step between the first hole 473-*a* and the second hole 473-*b*. Accordingly, the removing member 475 projects from the hole 473 (an opening in the lower surface of the floating plate 472). As a result, the removing member 475 presses the substrate Wf to remove it from the back plate assembly 470, and thus allows suppressing the substrate Wf sticking to the back plate assembly 470.

Figure 7:
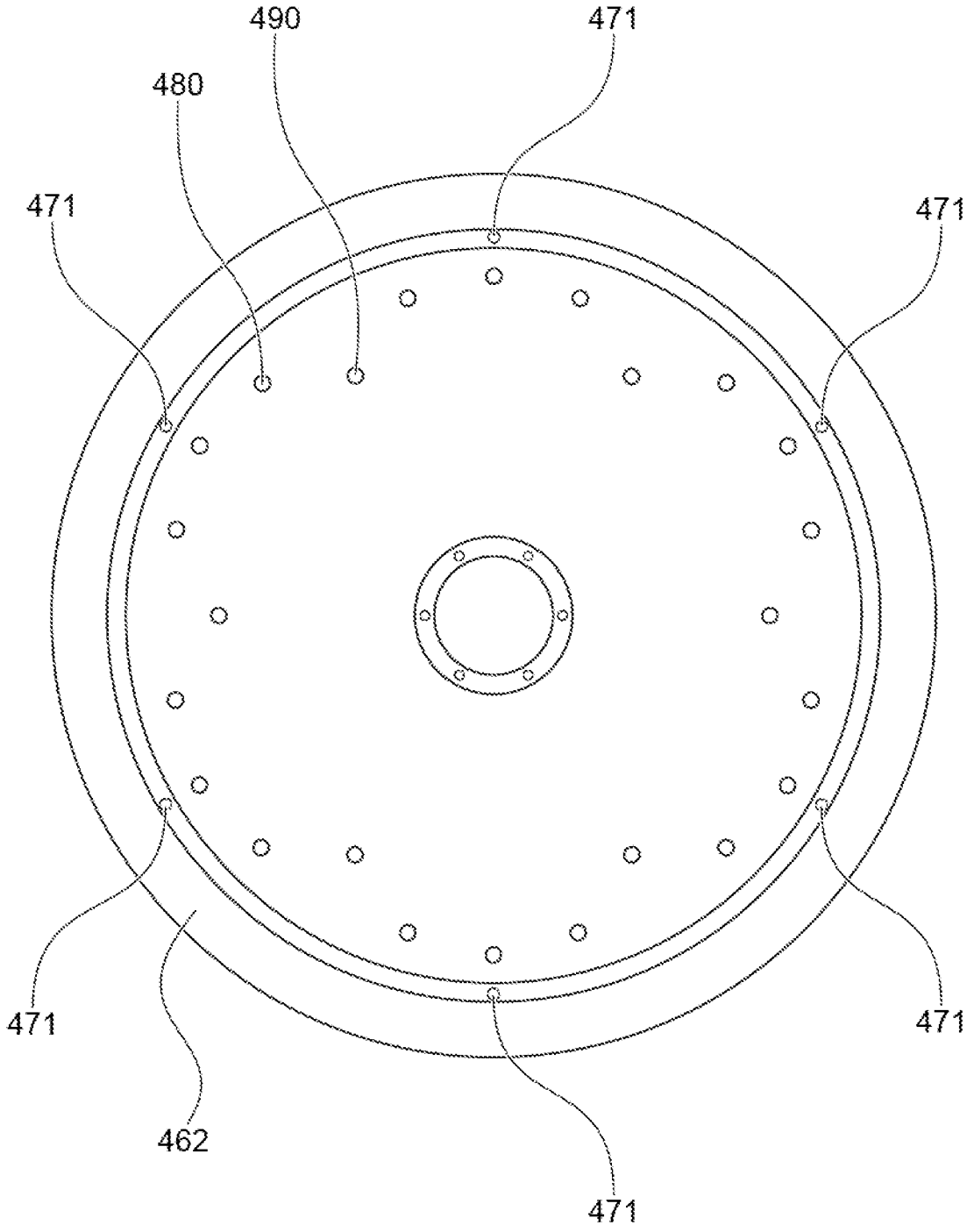
FIG. 7 is a plan view schematically illustrating the substrate holder of this embodiment.

FIG. 7 is a plan view schematically illustrating the substrate holder of this embodiment. As illustrated in FIG. 7, a plurality (6 pieces in this embodiment) of the removing mechanisms 471 are disposed in an outer peripheral portion of the floating plate 472 along the circumferential direction. By the removing mechanisms 471 being arranged in the outer peripheral portion of the floating plate 472, air becomes easier to enter between the substrate Wf and the floating plate 472, and thus allows efficiently suppressing the sticking of the substrate Wf caused by the surface tension. Further, by the plurality of the removing mechanisms 471 being disposed, the substrate Wf sticking to the back plate assembly 470 can be suppressed with more certainty.

The above-described embodiment has shown the example of making the removing member 475 project from the lower surface of the floating plate 472 using the elastic member 477, but it is not limited thereto. A modification of the removing mechanism 471 will be described below. Descriptions of configurations similar to the above-described embodiment will be omitted.

Figure 8:
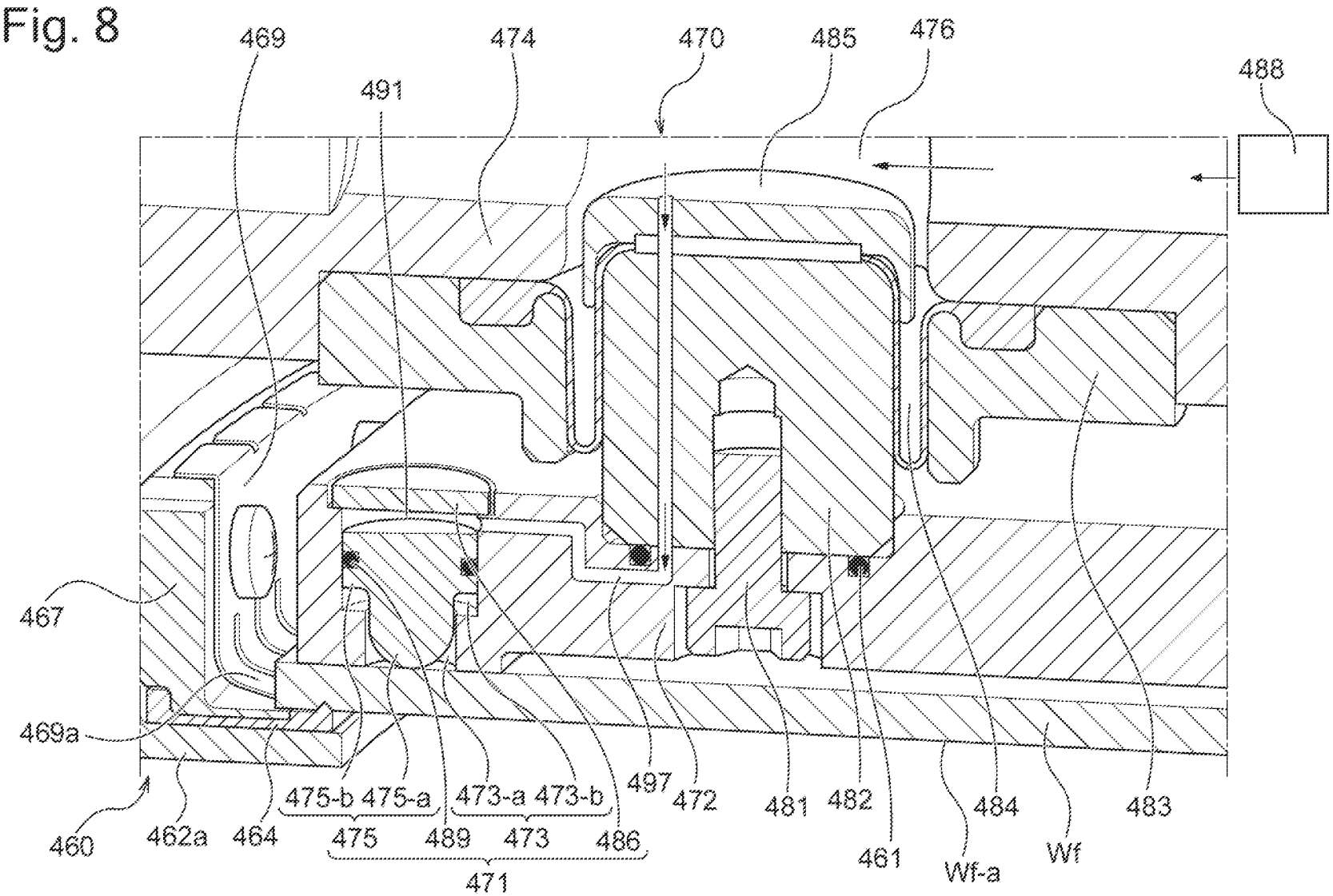
FIG. 8 is an enlarged perspective view schematically illustrating a part of a substrate holder of a modification.

FIG. 8 is an enlarged perspective view schematically illustrating a part of a substrate holder of the modification. The removing mechanism 471 includes the removing member 475 arranged in the hole 473 similar to that of the above-described embodiment, and the fluid source 488 for supplying a fluid that provides a force that causes the removing member 475 to project from the lower surface (the lower surface of the floating plate 472) of the back plate assembly 470.

The removing member 475 includes the removing pin 475-*a* having a size corresponding to the first diameter of the first hole 473-*a*, and the flange portion 475-*b* having a size corresponding to the second diameter is formed in the removing pin 475-*a*, but unlike the above-described embodiment, the hole is not formed in the central portion of the base end of the removing pin 475-*a*. A space 491 between the removing member 475 and the pedestal 486 communicates with the flow passage 476 via a flow passage 497 formed in the cap 485, the rod 482, and the floating plate 472. Accordingly, the fluid supplied from the fluid source 488 is introduced into the space 491. Due to the flow passage 497 being formed in the rod 482 and the floating plate 472, an O-ring 461 is interposed between a lower surface of the rod 482 and the upper surface of the floating plate 472 so as to suppress leakage of the fluid. Further, an O-ring 489 is interposed between a side surface of the flange portion 475-*b* of the removing member 475 and a side surface of the second hole 473-*b* so as to suppress leakage of the fluid.

According to this modification, in a state where the fluid is supplied from the fluid source 488 and the back plate assembly 470 (the floating plate 472) is pressing the substrate Wf, the removing member 475 is pulled into the hole 473. By gradually reducing an amount of the fluid supplied from the fluid source 488 after the plating process is completed in this state, the biasing force by the floating mechanism 490 becomes larger than the pushing force of the pushing mechanism 480, causing the back plate assembly 470 to be raised. At this point, since the fluid is still being supplied from the fluid source 488 to the space 491, the removing member 475 is pressed. In response, the removing member 475 moves downward until the flange portion 475-*b* of the removing in 475-*a* is brought into contact with a step between the first hole 473-*a* and the second hole 473-*b*. Accordingly, the removing member 475 projects from the hole 473 (the opening in the lower surface of the floating plate 472). As a result, the removing member 475 presses the substrate Wf to remove it from the back plate assembly 470, and thus allows suppressing the substrate Wf sticking to the back plate assembly 470.

Figure 9:
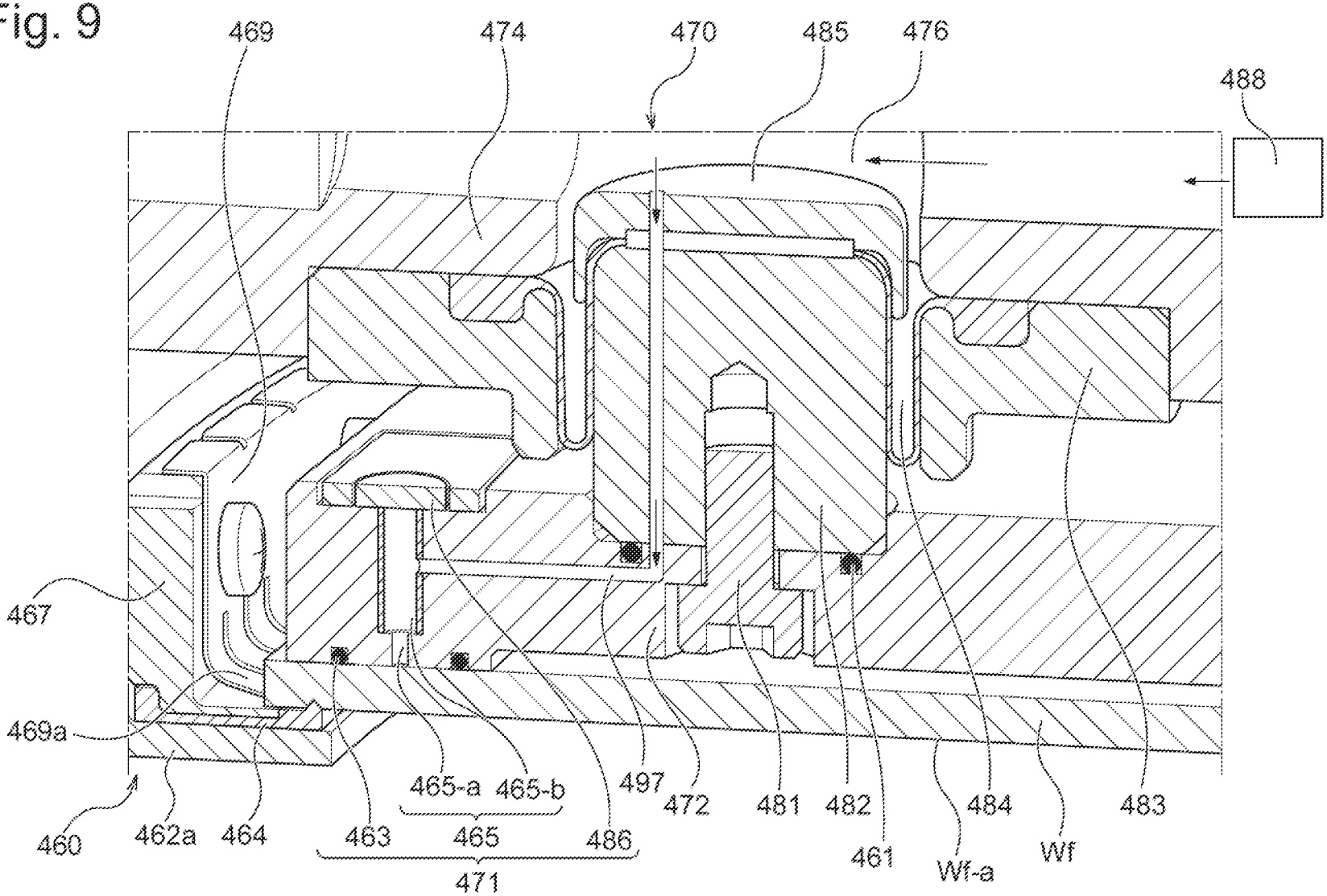
FIG. 9 is an enlarged perspective view schematically illustrating a part of the substrate holder of the modification.

FIG. 9 is an enlarged perspective view schematically illustrating a part of the substrate holder of the modification. The removing mechanism 471 includes a hole 465 opening in a surface in contact with the back surface of the surface to be plated Wf-a of the substrate Wf of the back plate assembly 470, and the fluid source 488 configured to supply a gas to the back surface of the surface to be plated Wf-a of the substrate Wf via the hole 465.

The hole 465 is formed including a first hole 465-*a* opening in the lower surface of the floating plate 472 and having a first diameter, and a second hole 465-*b* having a second diameter that is larger than the first diameter and communicating with the first hole 465-*a*. The hole 465 (the second hole 465-*b*) communicates with the flow passage 476 via the flow passage 497 formed in the cap 485, the rod 482, and the floating plate 472. Thus, the fluid supplied from the fluid source 488 is introduced into the hole 465 (the second hole 465-*b*). By the flow passage 497 being formed in the rod 482 and the floating plate 472, the O-ring 461 is interposed between the lower surface of the rod 482 and the upper surface of the floating plate 472 so as to suppress leakage of the fluid. Further, an O-ring 463 is interposed between the lower surface of the floating plate 472 and an upper surface of the substrate Wf so as to suppress leakage of the fluid.

According to this modification, after the plating process is completed, by gradually reducing the amount of the fluid supplied from the fluid source 488, the biasing force by the floating mechanism 490 becomes larger than the pushing force of the pushing mechanism 480, causing the back plate assembly 470 to be raised. At this point, since the gas is still being supplied from the fluid source 488 to the hole 465, the gas is supplied from the first hole 465-*a* to the upper surface of the substrate Wf. Accordingly, the gas presses the substrate Wf to remove it from the back plate assembly 470, and thus enables suppressing the substrate Wf sticking to the back plate assembly 470.

The several embodiments of the present invention have been described above in order to facilitate understanding of the present invention without limiting the present invention. The present invention can be changed or improved without departing from the gist thereof, and of course, the equivalents of the present invention are included in the present invention. It is possible to arbitrarily combine or omit respective components described in the claims and specification in a range in which at least a part of the above-described problem can be solved, or a range in which at least a part of the effects can be exhibited.

This application, as one embodiment, discloses a plating apparatus that includes a plating tank, a substrate holder, and an elevating mechanism. The plating tank is configured to house a plating solution. The substrate holder is configured to hold a substrate with a surface to be plated facing downward. The elevating mechanism is configured to move up and down the substrate holder. The substrate holder includes a supporting mechanism, a back plate assembly, and a removing mechanism. The supporting mechanism is configured to support an outer peripheral portion of the surface to be plated of the substrate. The back plate assembly is arranged on a back surface side of the surface to be plated of the substrate. The back plate assembly is configured to sandwich the substrate with the supporting mechanism. The removing mechanism is configured to provide a force that removes the substrate from the back plate assembly to a back surface of the surface to be plated of the substrate.

Further, this application, as one embodiment, discloses a plating apparatus in which the removing mechanism includes a removing member arranged in a hole opening in a surface to be in contact with the back surface of the surface to be plated of the substrate of the back plate assembly, and an elastic member that provides a force that causes the removing member to project from a lower surface of the back plate assembly.

Further, this application, as one embodiment, discloses a plating apparatus in which the removing mechanism includes a removing member arranged in a hole opening in a surface to be in contact with the back surface of the surface to be plated of the substrate of the back plate assembly, and a fluid source for supplying a fluid that provides a force that causes the removing member to project from a lower surface of the back plate assembly.

Further, this application, as one embodiment, discloses a plating apparatus in which the removing mechanism includes a fluid source configured to supply a gas to the back surface of the surface to be plated of the substrate via a hole opening in a surface to be in contact with the back surface of the surface to be plated of the substrate of the back plate assembly.

Further, this application, as one embodiment, discloses a plating apparatus in which a plurality of the removing mechanisms are disposed in an outer peripheral portion of the back plate assembly along a circumferential direction.

Further, this application, as one embodiment, discloses a plating apparatus in which the back plate assembly includes a floating plate arranged on the back surface side of the surface to be plated of the substrate, a floating mechanism for biasing the floating plate to a direction away from a back surface of the substrate, and a pushing mechanism for pressing the floating plate to the back surface of the substrate against a biasing force by the floating mechanism, and the removing mechanism is configured to provide a force that removes the substrate from the floating plate to the back surface of the surface to be plated of the substrate.

Further, this application, as one embodiment, discloses a plating apparatus in which the pushing mechanism includes a back plate arranged on an upper side of the floating plate, a flow passage formed inside the back plate so as to open to a lower surface of the back plate, a diaphragm arranged in the flow passage, a pressing member arranged between the diaphragm and the floating plate, and a fluid source for supplying a fluid to the diaphragm via the flow passage.

Further, this application, as one embodiment, discloses a plating apparatus in which the floating mechanism includes a shaft that extends upward from the floating plate via a through-hole of the back plate, a flange mounted on an upper portion of the shaft with respect to the back plate, and a spring member mounted on an upper surface of the back plate and the flange.

REFERENCE SIGNS LIST

400 . . . plating module
410 . . . plating tank
440 . . . substrate holder
442 . . . elevating mechanism
460 . . . supporting mechanism
462 . . . supporting member
470 . . . back plate assembly
471 . . . removing mechanism
472 . . . floating plate
473 . . . hole
473-*a* . . . first hole
473-*b* . . . second hole
474 . . . back plate
475 . . . removing member
475-*a* . . . removing pin
475-*b* . . . flange portion
476 . . . flow passage
477 . . . elastic member
480 . . . pushing mechanism
482 . . . rod
484 . . . diaphragm
488 . . . fluid source
490 . . . floating mechanism
492 . . . shaft
495 . . . flange
1000 . . . plating apparatus
Wf . . . substrate
Wf-a . . . surface to be plated

The invention claimed is:

1. A plating apparatus comprising:
a plating tank configured to house a plating solution;
a substrate holder configured to hold a substrate with a surface to be plated facing downward; and
an elevating mechanism configured to move up and down the substrate holder, wherein
the substrate holder includes:
a supporting mechanism configured to support an outer peripheral portion of the surface to be plated of the substrate;
a back plate assembly arranged on a back surface side of the surface to be plated of the substrate, the back plate assembly being configured to sandwich the substrate with the supporting mechanism; and
a removing mechanism configured to provide a force that removes the substrate from the back plate assembly to a back surface of the surface to be plated of the substrate,
wherein the back plate assembly includes:
a floating plate arranged on the back surface side of the surface to be plated of the substrate,
a floating mechanism for biasing the floating plate to a direction away from a back surface of the substrate, and
a pushing mechanism for pressing the floating plate to the back surface of the substrate against a biasing force by the floating mechanism, and
the removing mechanism is configured to provide a force that removes the substrate from the floating plate to the back surface of the surface to be plated of the substrate.

2. The plating apparatus according to claim 1, wherein
the removing mechanism includes:
a removing member arranged in a hole opening in a surface to be in contact with the back surface of the surface to be plated of the substrate of the back plate assembly; and
an elastic member that provides a force that causes the removing member to project from a lower surface of the back plate assembly.

3. The plating apparatus according to claim 1, wherein
the removing mechanism includes:
a removing member arranged in a hole opening in a surface to be in contact with the back surface of the surface to be plated of the substrate of the back plate assembly; and
a fluid source for supplying a fluid that provides a force that causes the removing member to project from a lower surface of the back plate assembly.

4. The plating apparatus according to claim 1, wherein
the removing mechanism includes a fluid source configured to supply a gas to the back surface of the surface to be plated of the substrate via a hole opening in a surface to be in contact with the back surface of the surface to be plated of the substrate of the back plate assembly.

5. The plating apparatus according to claim 1, wherein
a plurality of the removing mechanisms are disposed in an outer peripheral portion of the back plate assembly along a circumferential direction.

6. The plating apparatus according to claim 1, wherein
the pushing mechanism includes:
a back plate arranged on an upper side of the floating plate;
a flow passage formed inside the back plate so as to open to a lower surface of the back plate;

a diaphragm arranged in the flow passage;

a pressing member arranged between the diaphragm and the floating plate; and a fluid source for supplying a fluid to the diaphragm via the flow passage.

7. The plating apparatus according to claim 6, wherein the floating mechanism includes:

a shaft that extends upward from the floating plate via a through-hole of the back plate;

a flange mounted on an upper portion of the shaft with respect to the back plate; and a spring member mounted on an upper surface of the back plate and the flange.

* * * * *